US007937979B2

(12) United States Patent
Ghiran et al.

(10) Patent No.: US 7,937,979 B2
(45) Date of Patent: May 10, 2011

(54) GRAVITY FILL SYSTEM WITH PRESSURE CHECK VALVE

(75) Inventors: Mike M. Ghiran, Lake Orion, MI (US); Ranny Joe Nunley, Metamora, MI (US); David R. Friddell, Grand Blanc, MI (US); William M. Crantas, Highland, MI (US); Kevin R. Marks, Durand, MI (US); David R. Jensen, Swartz Creek, MI (US); Paul D. Larsen, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 325 days.

(21) Appl. No.: 12/189,877

(22) Filed: Aug. 12, 2008

(65) Prior Publication Data

US 2010/0037670 A1 Feb. 18, 2010

(51) Int. Cl.
*B21D 39/08* (2006.01)
*B23P 17/02* (2006.01)

(52) U.S. Cl. ..... 72/58; 72/61; 72/62; 29/421.1

(58) Field of Classification Search ..... 72/58, 59, 72/60, 61, 62, 63, 370.22; 29/421.1
See application file for complete search history.

(56) References Cited

U.S. PATENT DOCUMENTS

| | | | | |
|---|---|---|---|---|
| 5,445,002 | A | 8/1995 | Cudini et al. | |
| 5,511,404 | A * | 4/1996 | Klages et al. | 72/62 |
| 6,446,476 | B1 * | 9/2002 | Gmurowski | 72/58 |
| 6,532,785 | B1 * | 3/2003 | Gmurowski | 72/61 |
| 7,392,679 | B1 * | 7/2008 | Ghiran et al. | 72/58 |
| 7,685,856 | B1 * | 3/2010 | Ghiran et al. | 72/61 |

* cited by examiner

*Primary Examiner* — David B Jones
(74) *Attorney, Agent, or Firm* — Quinn Law Group, PLLC

(57) ABSTRACT

A hydroform die includes a plurality of seal units to provide fluid to die cavities. The plurality of seal units each define a piston cylinder. A piston is located within the cylinder and is selectively moveable between an open and a closed position. Additionally, the piston at least partially defines a valve chamber located on a first side of the piston and a piston chamber located on a second side of the piston. A piston fluid passage is defined by the piston to fluidly connect the valve chamber and the piston chamber.

16 Claims, 6 Drawing Sheets

GRAVITY FILL SYSTEM WITH PRESSURE CHECK VALVE

TECHNICAL FIELD

The present invention relates generally to hydroform dies, and more specifically to a fluid filling system for use with a hydroform die.

BACKGROUND OF THE INVENTION

Hydroforming dies are used to form a cross-sectional profile in tubular parts. Commonly, a tubular part is placed within a die cavity. The die cavity is then filled with fluid and pressurized to expand the tubular part outward against the die into the desired cross-sectional profile.

The hydroforming die cavity is typically filled in a two-stage process. In the first stage fluid, typically water, is inserted into the die cavity at a first pressure level. Once the die cavity has been filled, pressurized fluid at a higher pressurized level is added. The second stage of high pressure fluid is added to finalize forming of the component within the die cavity. Hydraulic pumps are used to provide the pressurized fluid for the hydroforming.

A low pressure high volume pump is typically used to fill the die cavity during the first fluid fill stage. However, the rate at which the hydraulic die can be filled is limited by the capacity of the low pressure pump. For larger parts the overall fill time for the die cavity can slow the hydroform process.

Furthermore, the low pressure pump allows air to enter the die cavity during the first fluid fill stage. The air must then be eliminated or compressed during the second higher pressure fluid fill stage, also adding time to the hydroform process. The larger the part that is being formed in the die and the greater the air pocket, the longer the forming process will take.

SUMMARY OF THE INVENTION

A hydroform die filling system that can provide fluid at a high flow rate while reducing the amount of air entering the component during the filling process is desired.

A hydroform die is provided that includes an upper die housing and a lower die housing. When the hydroform die is closed the upper die housing and the lower die housing together form a plurality of die cavities. A plurality of seal units is fluidly connected to the die cavities.

The plurality of seal units each define a piston cylinder. A piston is located within the cylinder and is selectively moveable between an open and a closed position. Additionally, the piston at least partially defines a valve chamber located on a first side of the piston and a piston chamber located on a second side of the piston. A piston fluid passage is defined by the piston to fluidly connect the valve chamber and the piston chamber.

A method for operating the hydraulic die includes placing a component within each die cavity, then filling the component with a fluid supplied through the seal unit. The seal unit is then closed to prevent fluid flow through the seal unit for a period of time, and the fluid within the component is allowed to settle. Next, the seal unit is opened to allow further fluid flow into the component, filling the air pocket that formed when the fluid settled.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENTS

Figure 1:
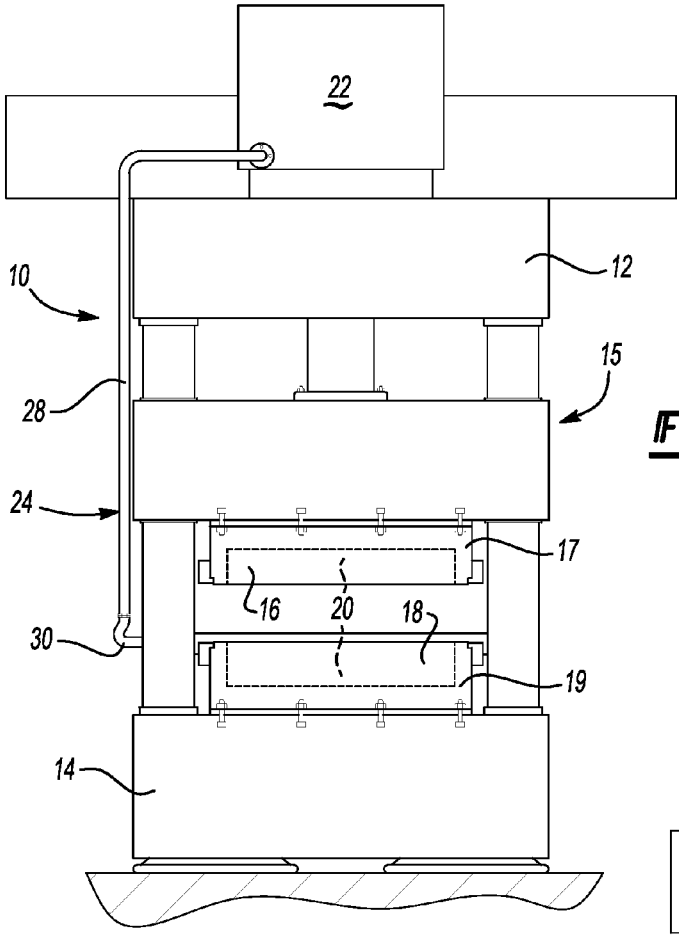
FIG. 1 is a schematic front view illustration of a press including a hydroforming die.
Figure 2:
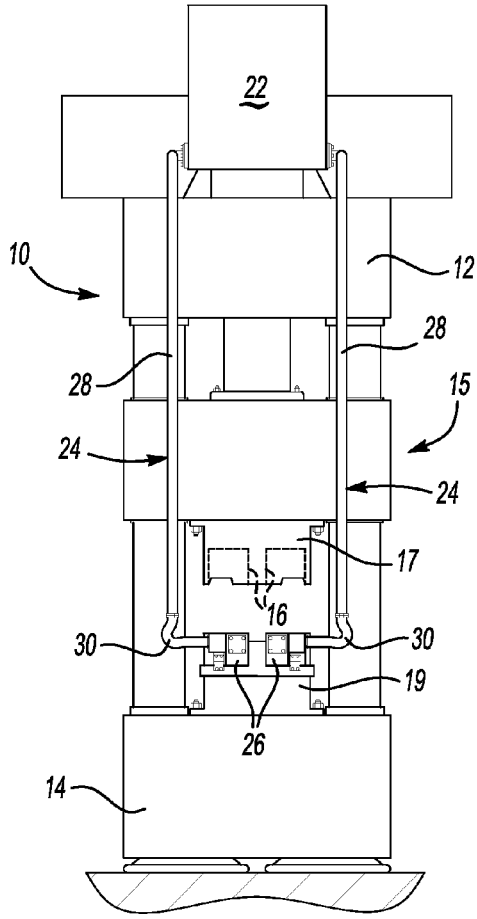
FIG. 2 is a schematic side view illustration of the press including the hydroforming die of FIG. 1.

Referring to the Figures, wherein like reference numbers refer to the same or similar components throughout the several views, FIG. 1 is a front view and FIG. 2 is a side view of an exemplary press.

The press 10 includes a press crown 12 and a press bed 14. A moveable press ram 15 is located in the press 10. The hydroforming die includes an upper die housing 17 mounted to the press ram 15 and a lower die housing 19 mounted to the press bed 14. At least one upper die cavity portion 16 is defined by the upper die housing 17 and at least one lower die cavity portion 18 is defined by the lower die housing 19. When the press 10 is closed, the upper die cavity portion 16 and the lower die cavity portion 18 together form a die cavity 20 which has a cross-section equivalent to the cross-section of the component (not shown) to be formed by the press 10.

A fluid supply tank 22 is connected to the die cavity 20 to provide fluid for filling the die cavity 20 and forming the component. The fluid supply tank 22 is supported by the press crown 12 or located in such a manner as to be above the die cavity 20. Gravity is then used to move the fluid from the fluid supply tank 22 to the die cavity 20

A filling tube 24 connects the fluid supply tank 22 to the die cavity 20. A seal unit 26 is located between the filling tube 24 and the die cavity 20. The height of the press crown 12 is sufficient to typically provide approximately 0.7 kg/cm$^2$ (10 psi) of pressure within the filling tube 24 due to the force of gravity on the fluid. The filling tube 24 includes a first portion 28 preferably formed of steel tubing, or the like and a second portion 30 preferably formed of flexible tubing, such as rubber tubing. The second portion 30 of the filling tube 24 allows for positioning and movement of the seal unit 26 relative to the filling tube 24, as needed.

As shown in FIG. 2, there can be multiple filling tubes 24, seal units 26 and die cavities 20 associated with the upper die housing 17 and the lower die housing 19. Commonly, two die cavities 20 are used to form matching components, i.e. a vehicle having a right side of the vehicle component and a left side of the vehicle component, wherein the right side and left side components are identical, or mirror images of one another, or have minimal differences between them.

Figure 3:
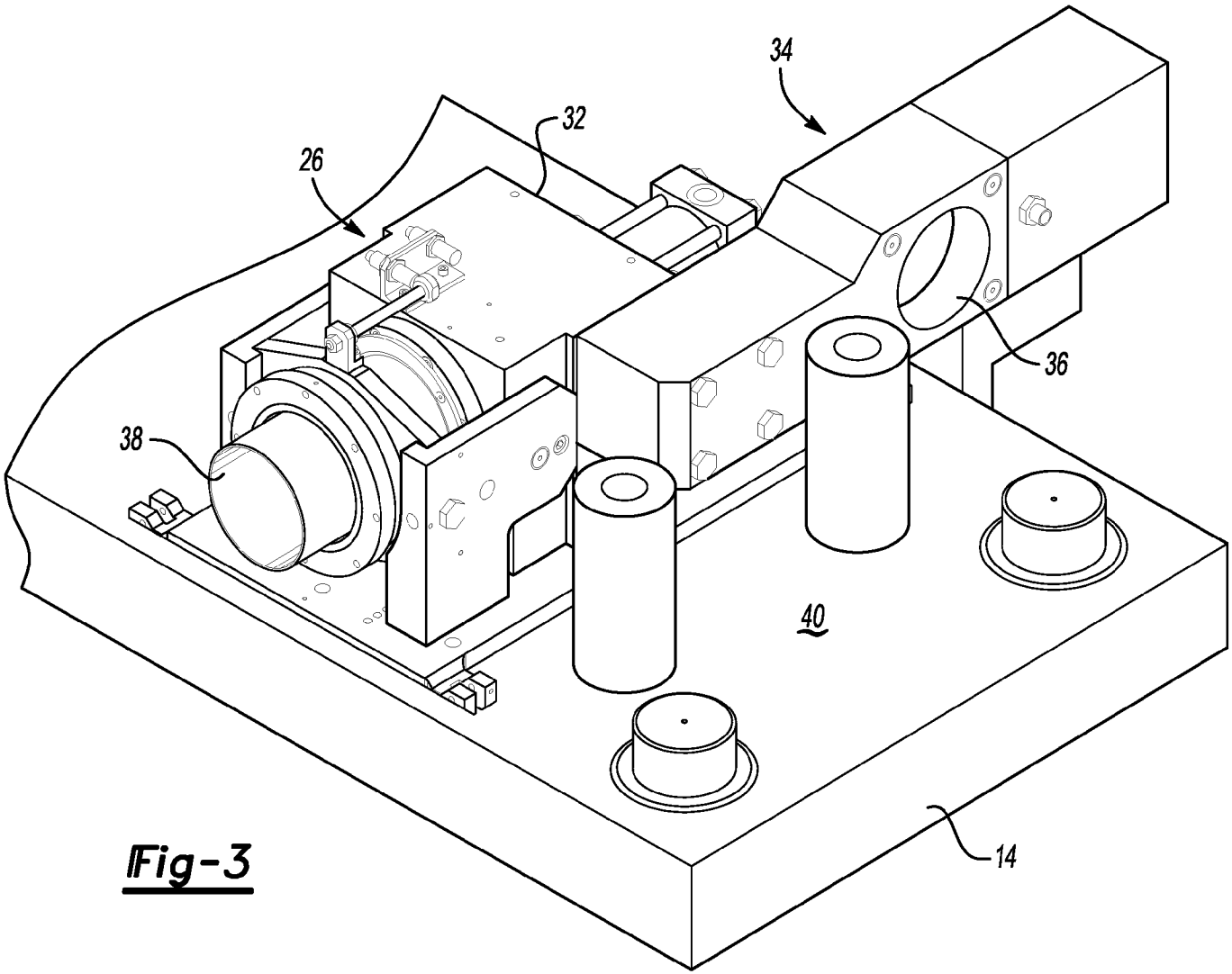
FIG. 3 is a schematic perspective view of a seal unit for the press and the hydroforming die of FIG. 1.

FIG. 3 illustrates a perspective schematic view of one seal unit 26 for the upper die housing 17 and the lower die housing 19. Additional seal units 26 would operate in a similar manner as described herein. The seal unit 26 includes a housing 32. Fluid, preferably water, enters the seal unit 26 through the filling tube 24 which is connected to a fill valve 34 through a valve inlet 36 defined by the housing 32. Fluid passes through the fill valve 34 and exits the seal unit 26 through a fluid passage 38.

The seal unit 26 is mounted to a platform 40 of the lower press bed 14. When the press 10 moves the upper die housing 17 and the lower die housing 19 to the closed position the platform 40 is moved upward through springs (not shown) located beneath the platform 40. The seal unit 26 is affixed to and moves with the platform 40. The second portion 30 of the filling tube 24 (shown in FIGS. 1 and 2) provides flexibility for the movement of the seal unit 26 relative to the fixed first portion 28 of the filling tube 24 (shown in FIGS. 1 and 2). Due to packaging restrictions on the platform 40 the overall shape of the seal unit 26 may vary. One skilled in the art would know the proper arrangement for the seal unit 26 relative to components located on the platform 40.

Figure 4:
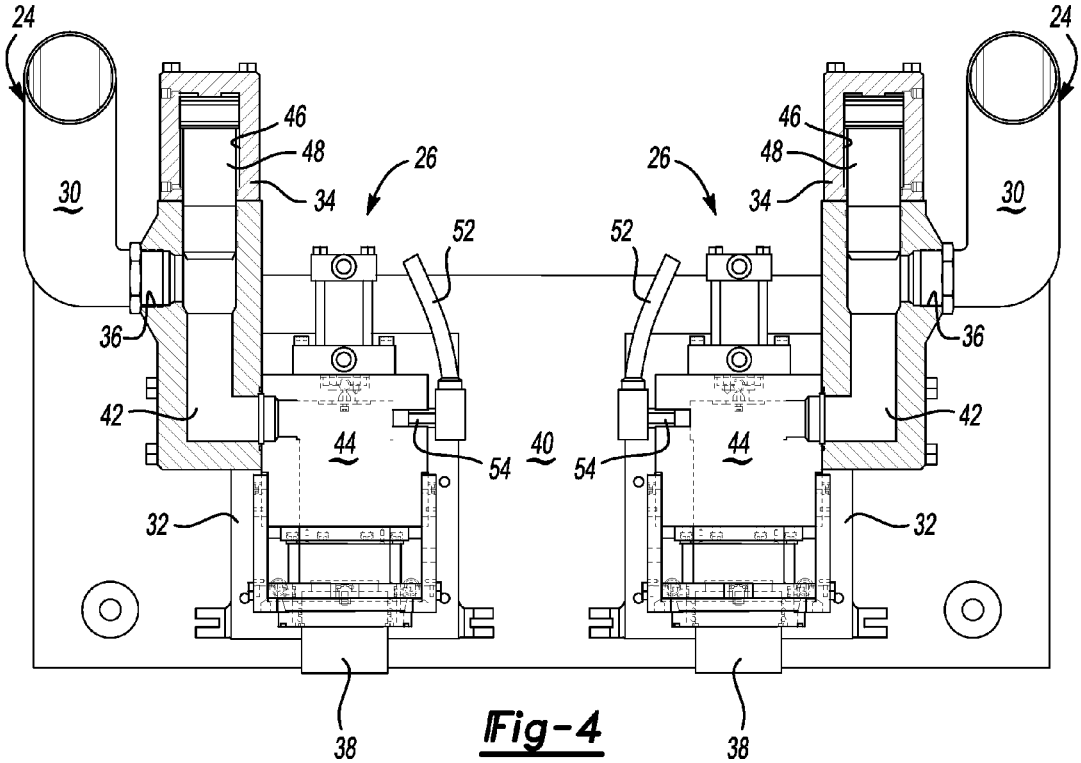
FIG. 4 is a schematic top view of the seal unit of FIG. 3 where a fill valve is in a first position.
Figure 5:
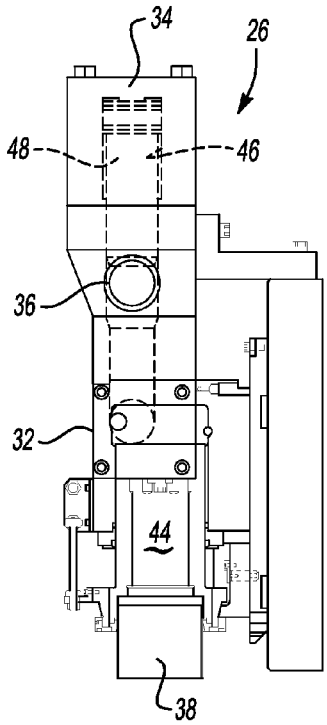
FIG. 5 is a schematic side view illustration of the seal unit of FIG. 4 where the fill valve is in the first position

FIG. 4 illustrates a top view of the platform 40 showing a schematic cross-sectional illustration of two seal units 26 in a first position and FIG. 5 illustrates a side view showing a schematic cross-section illustration of one seal unit 26 in the first position. Fluid is entering the seal unit 26 through the filling tube 24 connected to the fill valve 34. The fill valve 34 is in an open position allowing the fluid to enter a valve chamber 42. The valve chamber 42 is defined by the housing 32 and is fluidly connected to a main chamber 44 of the seal unit 26. The main chamber 44 leads to the fluid passage 38 where the fluid exits the seal unit 26.

Additionally, the seal unit 26 has a high pressure tube 52 connected to a high pressure inlet 54 which allows fluid to enter the main chamber 44 of the seal unit 26 during the high pressure fill stage. During the high pressure fill stage the piston 48 is in a closed position to prevent fluid flow through the valve inlet 36.

FIG. 5 shows a schematic side view of seal unit 26. The housing 32 defines a cylinder 46. A piston 48 is located within the cylinder 46 and biased by a spring 50 (shown in FIG. 6). In FIGS. 4 and 5 the piston 48 is located in an open position (the first position) such that fluid can freely enter the valve chamber 42 from the filling tube 24 through the valve inlet 36. The fluid passes through the valve chamber 42 and the main chamber 44 and exits the seal unit 26 through the fluid passage 38.

Figure 6:
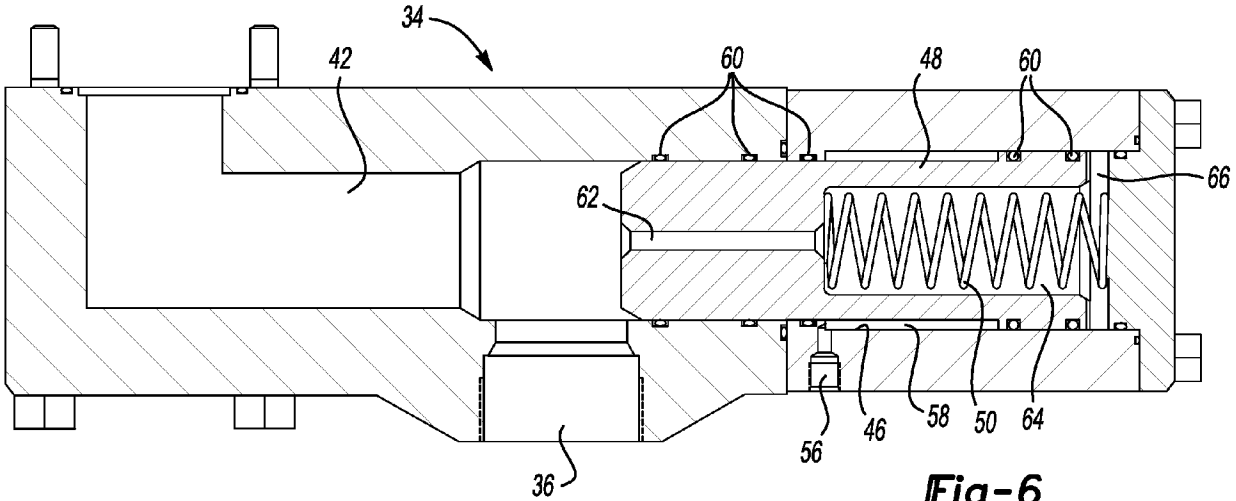
FIG. 6 is a cross-sectional view illustration of the fill valve of FIG. 4 in the first position.

FIG. 6 is an enlarged schematic cross-sectional view of the fill valve 34 in the first position, as shown in FIGS. 4 and 5. The fill valve 34 defines a piston fluid inlet 56 which allows a second fluid to enter and fill a piston fluid chamber 58. The second fluid in the piston fluid chamber 58 is preferably oil and a different fluid than that entering the valve chamber 42 through the valve inlet 36, which is preferably water. When the piston 48 is in the first position the piston fluid chamber 58 is filled with the second fluid. The fluid pressure within the piston fluid chamber 58 creates enough force in the piston 48 to overcome the bias created by spring 50. Thus, the piston 48 is in an open position allowing fluid to enter the valve chamber 42 through the fluid inlet 36, as shown. Seals 60 prevent the second fluid from leaking from the piston fluid chamber 58.

Figure 7:
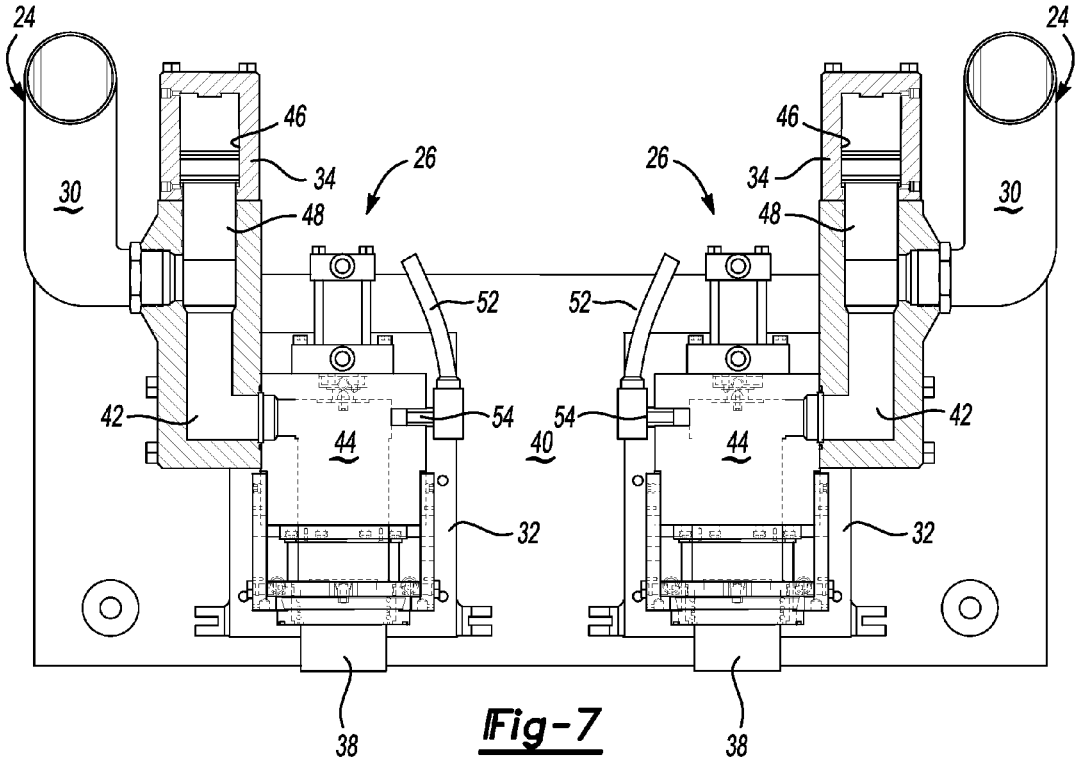
FIG. 7 is a schematic top view illustration of the seal unit of FIG. 3 where the fill valve is in a second position.
Figure 8:
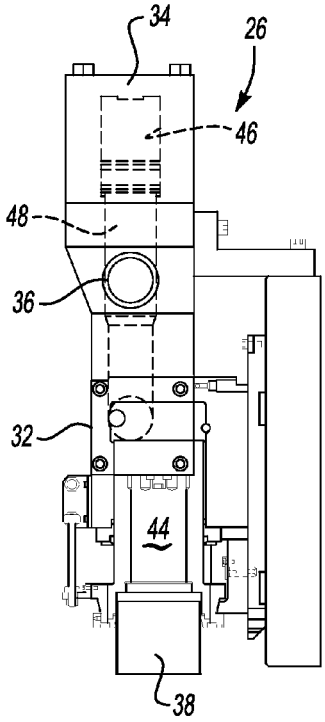
FIG. 8 is a schematic side view illustration of the seal unit of FIG. 6 where the fill valve is in the second position.

FIG. 7 illustrates a top view of the platform 40 showing a schematic cross-sectional illustration of two seal units 26 in a second position and FIG. 8 illustrates a side view showing a schematic cross-section illustration of one seal unit 26 in the second position. Fluid is prevented from entering the seal unit 26 through the fill valve 34 by the piston 48 when the piston 48 is in the closed position. The fill valve 34 is in a closed position (the second position illustrated in FIGS. 7 and 8) preventing the fluid from entering the valve chamber 42. The piston 48 has axially translated within the cylinder 46 due to the bias force of the spring 50 (shown in FIG. 9).

Figure 9:
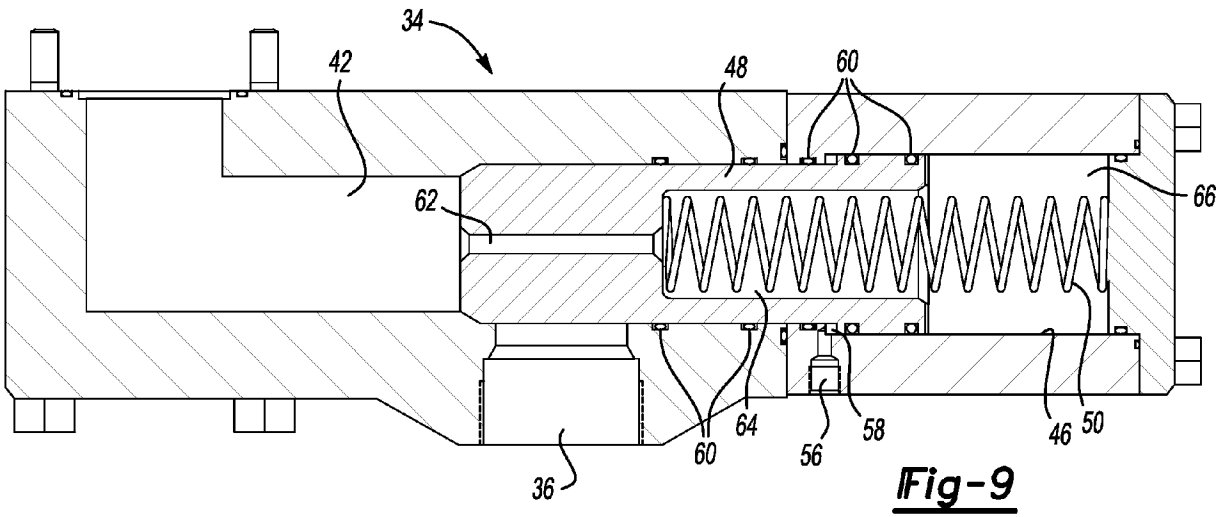
FIG. 9 is a cross-sectional view illustration of the fill valve of FIG. 6 in the second position.

FIG. 9 is an enlarged schematic cross-sectional view of the fill valve 34 in the second position, as shown in FIGS. 7 and 8. When the piston 48 is in the second position the second fluid exits the piston fluid chamber 58 through the piston fluid inlet 56. The fluid pressure within the piston fluid chamber 58 is reduced and the bias created by spring 50 moves the piston 48 to the closed position.

The piston 48 further defines a piston fluid passage 62 which allows fluid flow, of the first fluid, through the piston 48 to a piston chamber 64 and a rear valve chamber 66. The piston chamber 64 and the rear valve chamber 66 are fluidly sealed from the piston fluid chamber 58, by the seals 60. During the high pressure fill stage, the piston 48 is maintained in the closed position shown in FIG. 9. The piston fluid passage 62 allows the high pressure fluid from the valve chamber 42 to pass through the piston 48 to the piston chamber 64 and the rear valve chamber 66. This maintains an equal fluid pressure between the valve chamber 42 and the piston chamber 64 and rear valve chamber 66, preventing the high fluid pressure from overcoming the spring 50 bias.

Figure 10:
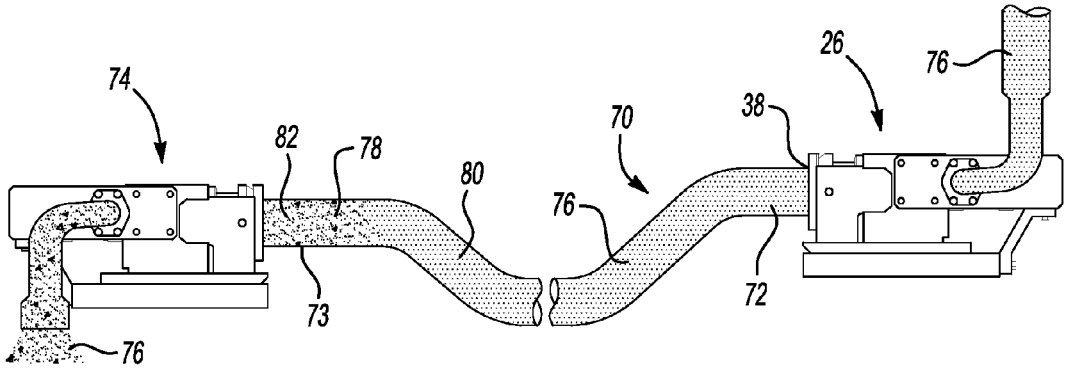
FIG. 10 is a schematic cross-sectional view illustration of a component in the hydraulic press of FIGS. 1 and 2 during a first portion of a first fluid fill stage.
Figure 11:
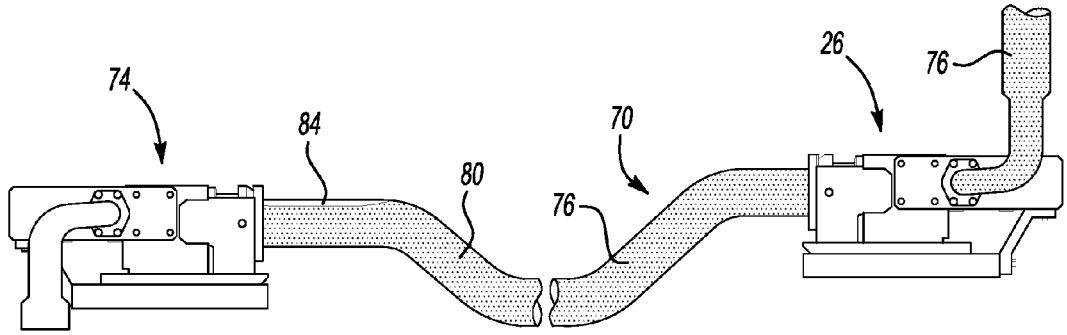
FIG. 11 is a schematic cross-sectional view illustration of the component in the hydraulic press of FIGS. 1 and 2 during a second portion of the first fluid fill stage.
Figure 12:
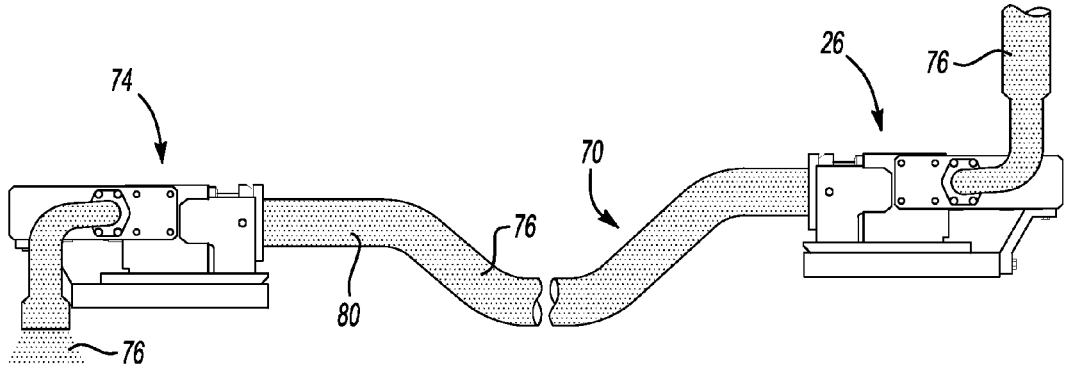
FIG. 12 is a schematic cross-sectional view illustration of a component in the hydraulic press of FIGS. 1 and 2 during a third portion of the first fluid fill stage.

FIGS. 10-12 illustrate the stages of the hydroform die 10 during the low pressure fill stage. A component 70 is mounted in the die cavity 20 (shown in FIGS. 1 and 2). A first end 72 of the component 70 is connected to the fluid passage 38 of the seal unit 26. A valve unit 74 is connected to the component 70 at an opposing end 73. The valve unit 74 may have the same configuration as the seal unit 26, or may be a typical one-way valve as is known in the art. Once the component 70 has been mounted, the seal unit 26 and the valve unit 74 are both opened. Fluid 76 enters the component 70 through the seal unit 26. As the fluid 76 fills the component 70 a first portion 78 of the fluid has turbulent flow and a second portion 80 of the fluid has laminar flow, as shown in FIG. 10. Due to the turbulent flow air 82 is still located within the component 70.

Once the component is full at least the valve unit 74 is closed for a period of time allowing the fluid 76 in the component 70 to settle. The seal unit 26 may also be closed at this time. A typical period of time for the valve unit 74 to be closed is 0.5 seconds. The settled air 82 forms an air pocket 84, as shown in FIG. 11. The valve unit 74 and seal unit 26 are then reopened. The fluid 76, having laminar flow, moves the air pocket 84 out through the valve unit 74, as shown in FIG. 12. The valve unit 74 and the seal unit 26 are typically opened for this period for approximately 1-2 seconds. Both the valve unit 74 and the seal unit 26 are then closed. The entire filling process for the component 70 typically takes approximately 6 seconds. The time required for the filling process will vary with respect to the size of the component 70.

In addition to controlling fluid flow to the component 70, the seal unit 26 protects the filling tube 24 from being subject to high fluid pressures during the second, high pressure, fill stage. The high pressure fill stage allows fluid 76 to continue entering the component 70 through the seal unit 26. Specifically, through the high pressure inlet 54, shown in FIGS. 4 and 7. Once the component 70 has been formed the seal unit 26 is closed and the fluid 76 exits the component through the valve unit 74.

Using a gravity driven fluid supply tank 22 for the hydroforming fluid provides fluid at a relatively high flow and pressure. Temporarily closing and reopening the seal unit 26 allows the air 82 entering the component 70 through turbulent water flow 78 to be eliminated. Thus, the overall time to fill and pressurize the component 70 is reduced.

While the best modes for carrying out the invention have been described in detail, those familiar with the art to which this invention relates will recognize various alternative designs and embodiments for practicing the invention within the scope of the appended claims.

The invention claimed is:

1. A hydraulic die comprising:

at least one seal unit, wherein the at least one seal unit defines a piston cylinder;

a piston located within the cylinder selectively moveable between an open and a closed position, wherein the piston at least partially defines a valve chamber located on a first side of the piston and a piston chamber located on a second side of the piston; and wherein a piston fluid passage is defined by the piston to fluidly connect the valve chamber and the piston chamber.

2. The hydraulic die of claim 1, further comprising a spring located within the cylinder to bias the piston to a closed position.

3. The hydraulic die of claim 1, wherein the seal unit and the piston at least partially define a piston fluid chamber, wherein the piston fluid chamber is selectively filled with a fluid to move the piston between the open and the closed position.

4. The hydraulic die of claim 3, wherein a plurality of seals is located between the piston and the seal unit to seal the piston fluid chamber from the valve chamber and the piston chamber.

5. The hydraulic die of claim 1, further comprising:

an upper die housing and a lower die housing defining at least one die cavity located therebetween;

wherein the seal unit is fluidly connected to the at least one die cavity.

6. The hydraulic die of claim 1, further comprising a fluid supply tank fluidly connected to the seal unit, wherein the fluid supply tank supplies a fluid to the seal unit using gravity.

7. A hydraulic die comprising:

an upper die housing and a lower die housing defining a plurality of die cavities located therebetween;

a plurality of seal units, wherein each seal unit defines a piston cylinder and includes:

a respective piston located within each respective cylinder and selectively moveable between an open and a closed position, wherein each piston at least partially defines a respective valve chamber located on a first side of the piston;

a respective piston chamber located on a second side of the piston, and a respective piston fluid passage to fluidly connect the respective valve chamber and the respective piston chamber; and wherein the respective valve chamber for each of the plurality of seal units is fluidly connected with the plurality of die cavities.

8. The hydraulic die of claim 7, wherein each seal unit further comprises a spring located within the respective cylinder to bias the respective piston to the closed position.

9. The hydraulic die of claim 7, wherein each respective cylinder and piston at least partially define a piston fluid chamber, wherein the piston fluid chamber is selectively filled with a fluid to move the piston between the open and the closed position.

10. The hydraulic die of claim 7, wherein a plurality of seals is located between the piston and the cylinder of each seal unit to seal the piston fluid chamber from the valve chamber and the piston chamber.

11. The hydraulic die of claim 7, further comprising a fluid supply tank fluidly connected to the plurality of seal units, wherein the fluid supply tank supplies a fluid to the plurality of seal units using gravity.

12. A method for operating a hydraulic die comprising:

placing at least one component within at least one die cavity;

filling the at least one component with a fluid supplied through at least one seal unit;

closing the seal unit to prevent fluid flow through the seal unit for a period of time; and opening the seal unit to allow further fluid flow into the component;

wherein the period of time is sufficient to allow the fluid within the component to settle, thereby forming an air pocket; and wherein the opening the seal unit is sufficient to allow laminar fluid flow to enter the at least one component and the air pocket to exit the at least one component.

13. The method of claim 12, further comprising selectively controlling fluid flow at an opposing end of the at least one component with a valve unit.

14. The method of claim 13, further comprising closing the valve unit at the same time as the closing the seal unit and opening the valve unit at the same time as the opening the seal unit.

15. The method of claim 12, further comprising adding fluid through a second passage in the seal unit to increase the fluid pressure within the at least one component.

16. The method of claim 12, wherein the filling the at least one component comprises supplying a fluid to the at least one seal unit using gravity to drive the fluid flow.

* * * * *